US007622677B2

(12) United States Patent
Barberree et al.

(10) Patent No.: US 7,622,677 B2
(45) Date of Patent: Nov. 24, 2009

(54) MINERAL INSULATED METAL SHEATHED CABLE CONNECTOR AND METHOD OF FORMING THE CONNECTOR

(75) Inventors: Daniel A. Barberree, Kingwood, TX (US); Jose E. Cardenas, Houston, TX (US); Lee Transier, Kingwood, TX (US); Rick Zerafin, Humble, TX (US)

(73) Assignee: Accutru International Corporation, Kingwood, TX (US)

( * ) Notice: Subject to any disclaimer, the term of this patent is extended or adjusted under 35 U.S.C. 154(b) by 0 days.

(21) Appl. No.: 11/862,056

(22) Filed: Sep. 26, 2007

(65) Prior Publication Data

US 2008/0073104 A1 Mar. 27, 2008

Related U.S. Application Data

(60) Provisional application No. 60/847,039, filed on Sep. 26, 2006.

(51) Int. Cl.
*H01R 4/18* (2006.01)

(52) U.S. Cl. ..... 174/88 R; 174/84 C

(58) Field of Classification Search ..... 174/84 C, 174/88 R

See application file for complete search history.

(56) References Cited

U.S. PATENT DOCUMENTS

| | | | | | |
|---|---|---|---|---|---|
| 2,981,787 | A * | 4/1961 | Brautigam et al. | ..... | 174/84 C |
| 3,441,658 | A * | 4/1969 | Smith et al. | ..... | 174/88 R |
| 3,517,112 | A * | 6/1970 | Wahl | ..... | 174/75 R |
| 4,407,065 | A * | 10/1983 | Gray | ..... | 29/828 |
| 4,482,174 | A | 11/1984 | Puri | | |
| 4,570,715 | A * | 2/1986 | Van Meurs et al. | ..... | 166/302 |
| 6,759,592 | B1 | 7/2004 | Cai et al. | | |
| 2002/0166693 | A1 * | 11/2002 | Dancy | ..... | 174/76 |

OTHER PUBLICATIONS

Mineral Insulated Cable; www.micable.com/mic05.html.

R.S. Means Co., Electrical Cost Data 22nd Annual Edition, 1999, ISBN 0-87629-504-9; http//en.wikipedia.org/wiki/ Mineral-insulated_copper-clad_cable.

* cited by examiner

*Primary Examiner*—Chau N Nguyen
(74) *Attorney, Agent, or Firm*—Bracewell & Giuliani LLP

(57) ABSTRACT

A connection for a mineral insulated metal sheathed cable, wherein the connection employs a compression fitting. The connection may make up two or more mineral insulated metal sheathed cables wherein one or more of the cables may be secured with a compression fitting. The connection may splice together two individual cables, or a cable to an electrical element.

25 Claims, 4 Drawing Sheets

MINERAL INSULATED METAL SHEATHED CABLE CONNECTOR AND METHOD OF FORMING THE CONNECTOR

RELATED APPLICATIONS

This application claims priority from U.S. Provisional Application No. 60/847,039, filed Sep. 26, 2006, the full disclosure of which is hereby incorporated by reference herein.

BACKGROUND

1. Field of Invention

This disclosure relates in general to connections of mineral insulated metal sheathed (MIMS) cables and a method for forming the connection. More specifically, the disclosure relates to a compression fitting used for splicing together ends of MIMS cable.

2. Description of Prior Art

Mineral insulated cables are used for conducting electricity either to provide power to a separate component or for heating the cable itself as a heating element. Mineral insulated cables are also used for sensing ambient conditions, such as temperature or pressure. The mineral insulation enables MIMS use in harsh environments, such as extreme temperature. Typically, the outer surface or outer sheath of the mineral insulated cables (MIMS) is comprised of a high temperature metal, such as stainless steel. MIMS cable assemblies typically comprise a conductive member or conductive element (such as a wire) covered with mineral insulation. The mineral insulation typically is magnesium oxide (MgO). Magnesium oxide has been chosen as the insulation material since it exhibits stability at high temperatures and it does not react with either the conductive element or the metal sheath.

MIMS cables are formed by inserting the conductive element within a metal tube then adding magnesium oxide to the annulus between the wire and tube. The combination is then either swaged or pulled through a reduced diameter element, such as a die, thereby reducing its diameter and compressing the tube and insulation tightly around the wire to form a cohesive unit.

MIMS cables are used for many applications where conductors inside the cable must be protected from the harsh and ambient environment and insulated from one another and from the sheath. These applications include electrical and instrumentation cables, thermalcouple, and RTD cables exposed to chemical processes and other harsh conditions. Additionally, resistance type cables may also be employed with this cable that operate up to high temperatures. It is required from time to time to splice MIMS cables together, either to repair damaged cable or to add components in line, as well as the need to construct a long length of cable from shorter pieces. Care must be taken when forming these splices since the magnesium oxide is quite hygroscopic and absorbs moisture when exposed to ambient conditions. Moisture trapped in the cable can reduce both its thermal and electrical insulating effectiveness directly and can degrade the magnesium oxide also adversely affects its insulating properties. Accordingly, the performance of the cable would be affected by moisture content within the magnesium oxide or other insulating materials that might be used.

Splicing kits are available for MIMS cables. However, the kits are specific to certain types of cables and usually not effective in maintaining the original properties of the cable after the sheath has been breached. The cable will lose its effectiveness or deteriorate more quickly if the electrical, thermal, or mechanical properties of the cable are compromised. For example, a contaminated MIMS cable has a reduced voltage capacity and is prone to inducing a short in the circuit. Similarly, damaged MIMS cables associated with sensing devices will affect the voltage output thereby compromising the efficacy of the sensing unit. Accordingly, room for improvement exists in methods for providing splices in mineral insulated metal sheathed cable assemblies.

SUMMARY OF INVENTION

The present disclosure includes a splice assembly for a mineral insulated metal sheathed cable comprising a cable assembly comprising a first conducting element and mineral insulation disposed on the first conducting element, a connection between the first conducting element with a second conducting element, a compression fitting affixed to the cable assembly, and a coupling mechanically affixed to the compression fitting and in securing engagement with the second conducting element. The compression fitting comprises an annular sleeve having an inclined outer circumference and a swage ring coaxially slideable over the sleeve, positioning the swage ring on the incline compresses the sleeve thereby inwardly deforming the sleeve annular diameter. In one optional embodiment the coupling also is a compressive fitting. Mineral insulation may be disposed on the second conducting element. In one embodiment, the splice assembly further comprises an electrical element in electrical communication with the second conducting element. The electrical element may be a heating element, an igniter, a pilot light, or some other electrical or sensing device. The splice assembly may optionally further comprise a third conducting element joined at the connection, the third conducting element may be mechanically coupled to the compression fitting and may include a compression fitting.

Also included herein is a method of forming a spliced connection for a mineral insulated metal sheathed cable assembly comprising, sliding an annular coupling body onto the cable assembly, wherein the coupling body includes a compressive fitting and the cable assembly comprises a first electrically conducting element, forming a connection between the first electrically conducting element and a second electrically conducting element, positioning the coupling body over the connection, and activating the compressive fitting thereby affixing the coupling to the mineral insulated metal sheathed cable assembly. The second electrically conducting element may optionally be part of a second mineral insulated metal sheathed cable assembly and wherein the coupling body further comprises a second compressive fitting disposed adjacent the second cable assembly. In this embodiment the method may further comprise activating the second compressive fitting thereby coupling the second cable assembly to the coupling body. The second conducting element may optionally comprise an electrical component where the electrical component may be a heating element, an igniters or a pilot.

Yet optionally further included herein is an apparatus for splicing a mineral insulated metal sheathed cable assembly comprising an annular coupling body comprising a sleeve having an outer surface and an inclined portion on the outer surface, a connection formed by joining a first electrically conducting wire and a second electrically conducting wire, wherein the connection is disposed within the body, mineral insulation disposed on the first electrically conducting wire and a sheath on the insulation thereby forming a cable assembly, wherein at least a portion of the cable assembly extends into the body, and a swage member slidingly positioned on the inclined portion of the sleeve outer surface inwardly deforming the sleeve into compressive engagement with the cable assembly and affixing the cable assembly within.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
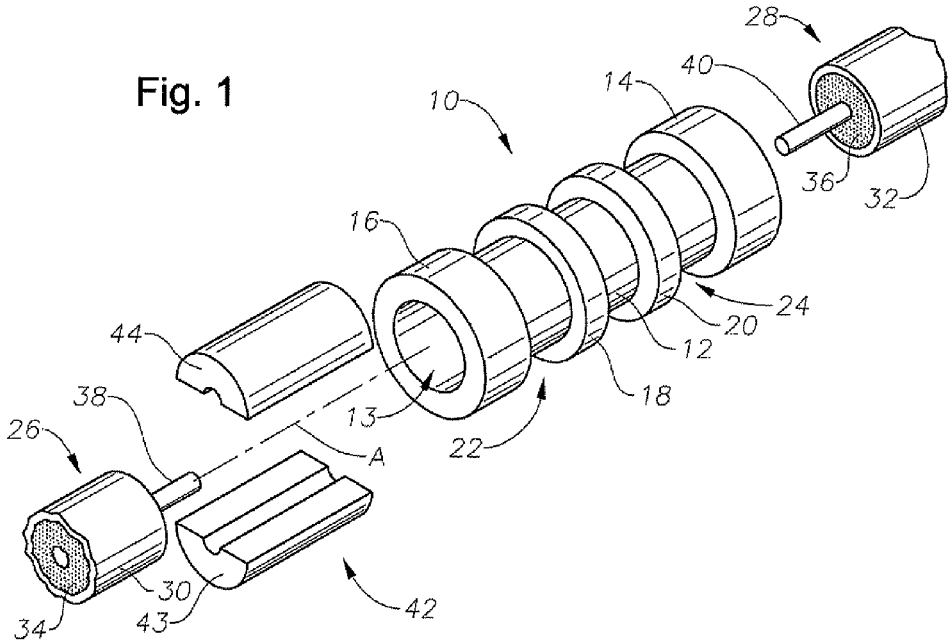
FIGS. 1-3 are perspective views of an embodiment of a MIMS cable coupling.
Figure 2:
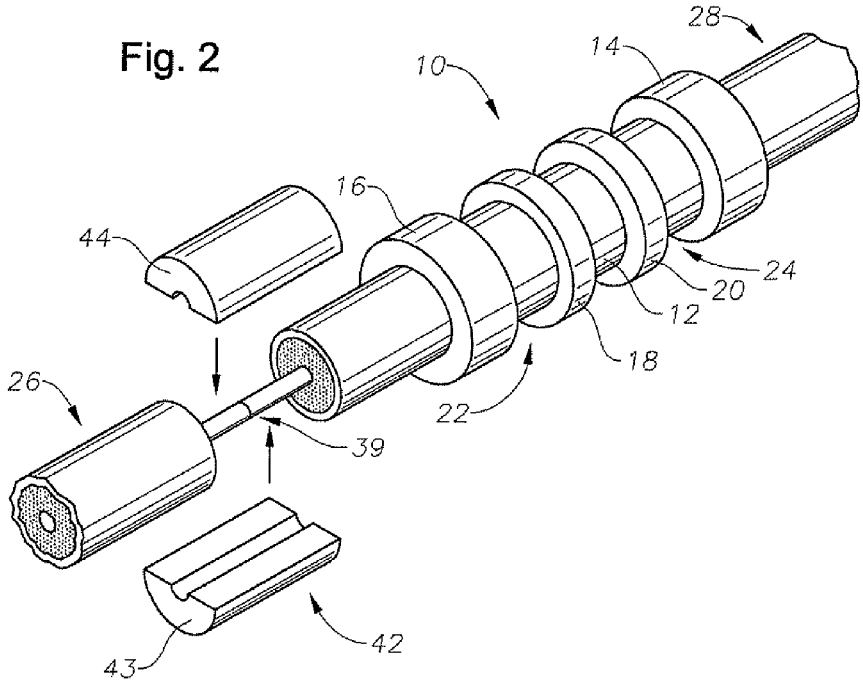
Figure 3:
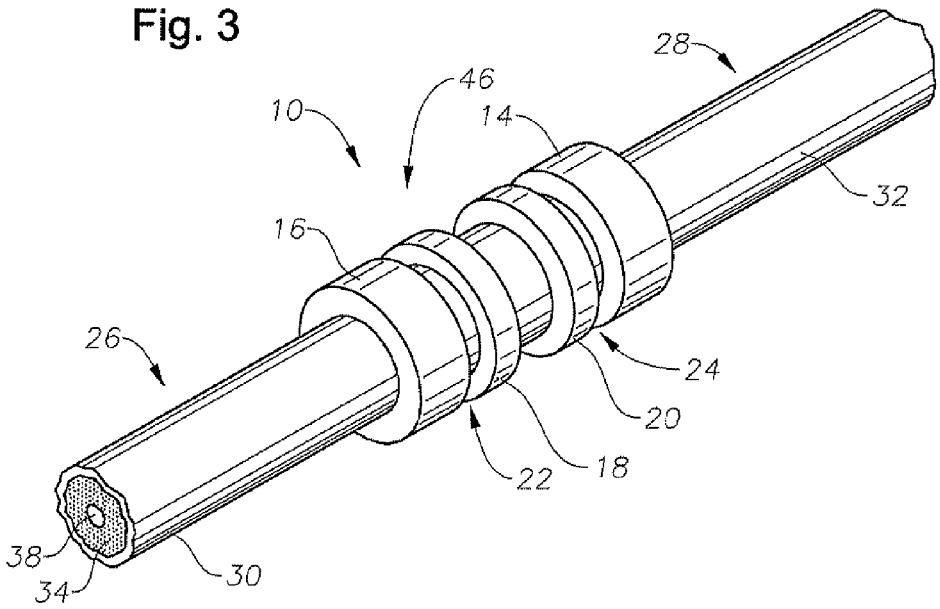

FIGS. 1-3 illustrate one embodiment of a method for forming a MIMS cable splice assembly. The splicing assembly comprises at least one MIMS cable having a first conducting element, a compression fitting for attachment to the MIMS cable, a second conducting element, and a coupling for attaching the second conducting element to become mechanically affixed to the splicing assembly.

Referring now to FIG. 1, one embodiment of a coupling 10 of the present disclosure is shown in an exploded perspective view. The coupling 10 comprises a body 12 having swage rings (14, 16) coaxially disposed on the outer surface of the body 12. Also coaxially formed on the body are flanges (18, 20) shown radially extending out from the body and between the opposing swage rings (14, 16). The swage rings (14, 16) and flanges (18, 20) all extend radially outward from the body 12 at different locations on the body axis. Grooves (22, 24) are therefore formed between adjacent swage rings and flanges. The body 12 has a generally annular configuration having a bore 13 formed therethrough generally coaxial with the body axis A. As will be described below, the bore 13 is formed to receive corresponding MIMS cables therethrough enabling sliding the body 12 along a portion of a MIMS cable assembly. A coupling having swage rings (compression fitting) may be obtained from Lokring Technology, L.L.C., 38376 Apollo Parkway, Willoughby, Ohio 44094, http://www.lokring.com/technical/htm.

Cable assemblies (26, 28) are shown extending substantially parallel to the body axis A. Each cable assembly (26, 28) comprises a conductor (38, 40), also referred to herein as a conducting element or conducting member, wherein each conductor (38, 40) includes insulation (34, 36) disposed along a portion of its outer periphery. The conductors (38, 40) may comprise any electrically or heat conducting material. Examples of materials include copper, silver, nickel, and gold, combinations thereof, and alloys thereof. The material comprising the insulation (34, 36) may comprise any insulating material, including mineral insulators such as magnesium oxide. Alumina oxide, zirconium oxide, hafnium oxide, nitrides, or other high temperature ceramics are other potential candidates for the insulating material.

Referring now to FIG. 2, the coupling 10 is now shown positioned over one of the cable assemblies and the first and second conductors (38, 40) are joined together to form a connection 39. Examples of ways to form the connection include soldering, welding, brazing, as well as electrically conducting adhesives. Prior to forming the connection, the insulating material and sheath covering the respective portions of the conductor (38, 40) is removed to enable making up the connection 39.

Optionally, insulating materials in the form a split preform 42 may be included over the region of these conductors that form the connection 39. This split preform 42 may be comprised of insulation similar to or the same as the insulation included with each of the cable assemblies. In one embodiment the perform 42 comprises a crushable sintered form of the mineral insulation. To facilitate placement of the insulating material over the connection, the split preform 42 is applied in sections comprising a first preform section 43 and a second preform section 44. These preform sections (43, 44) are drawn together over the connection 39 for insulating this region of the electrically conducting elements. After installing the split preform 42, the coupling 10 is slid along the cable assembly 28 and positioned over the connection 39 disposing the opposing swage rings (14, 16) on opposite sides of the split preform 42.

Referring now to FIG. 3, one embodiment of a final assembled cable connection 46 (also referred to herein as a splice assembly) is provided in a perspective view. In this embodiment, the opposing swage rings (14, 16) are shown having been slid from their original position in FIG. 2. along the body 12 toward their respective flanges (18, 20). As will be described in more detail below, the coupling 10 is configured to grasp the associated cable assembly (26, 28) by sliding the swage rings (14, 16) inwardly towards their respective flanges (18, 20). Accordingly, a securing engagement is achieved by activating the compressive fitting by sliding the swage rings to affix the coupling body 12 to its respective cable assembly.

Figure 4:
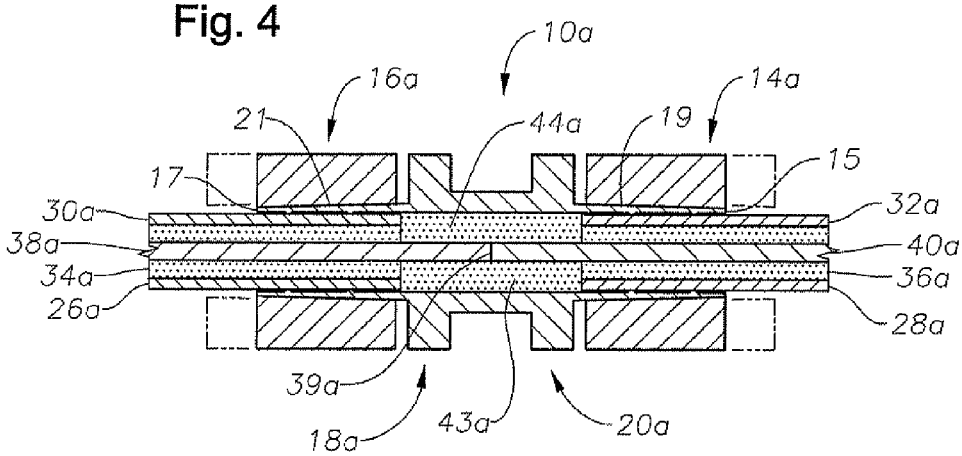
FIG. 4 is a cut-away side view of an embodiment of a MIMS cable coupling.

FIG. 4, shown in a side cutaway view illustrates operation of the compression fittings employed on the coupling 10. The swage rings (14*a*, 16*a*) are shown in a non-compressive position as illustrated in the dashed outline. Each swage ring (14*a*, 16*a*) is coaxially disposed over a corresponding sleeve (15, 17). Each sleeve (15, 17) has an inclined outer surface (19, 21) wherein the inclines run generally parallel to the axis of the coupling body 12*a*. Each inclined surface (19, 21) results in an increased radius of the sleeve (15, 17) proximate to the adjacent flanges (18*a*, 20*a*). Sliding movement of the respective swage rings (14*a*, 16*a*) inwardly compresses the inclined surfaces (19, 21) and deforms the sleeves (15, 17) thereby providing an inward compressive force of each sleeve (15, 17) onto the corresponding cable assembly (26*a*, 28*a*). While the compressive force also deforms the respective sheath (30*a*, 32*a*) and insulation (34*a*, 36*a*), the conductors (38*a*, 40*a*) are unaffected. To prevent the deleterious effects of moisture in the splice assembly, the assembly may be assembled in a low moisture environment, or can be heated to evaporate resident moisture trapped in the insulation before activating the swage ring. Evaporating the moisture can be performed in the field.

Figure 5:
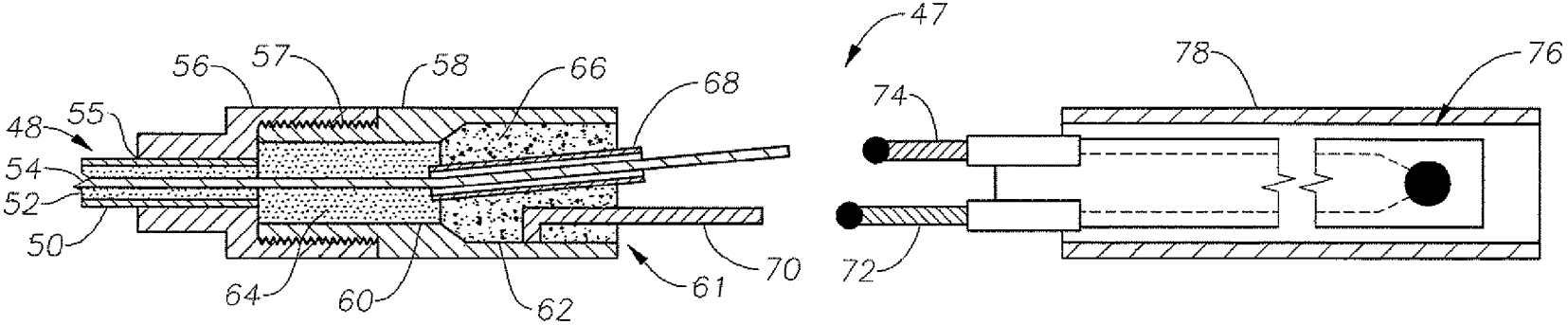
FIGS. 5 and 6 are cut-away side views of connector splicing a MIMS cable to an electrical element.
Figure 6:
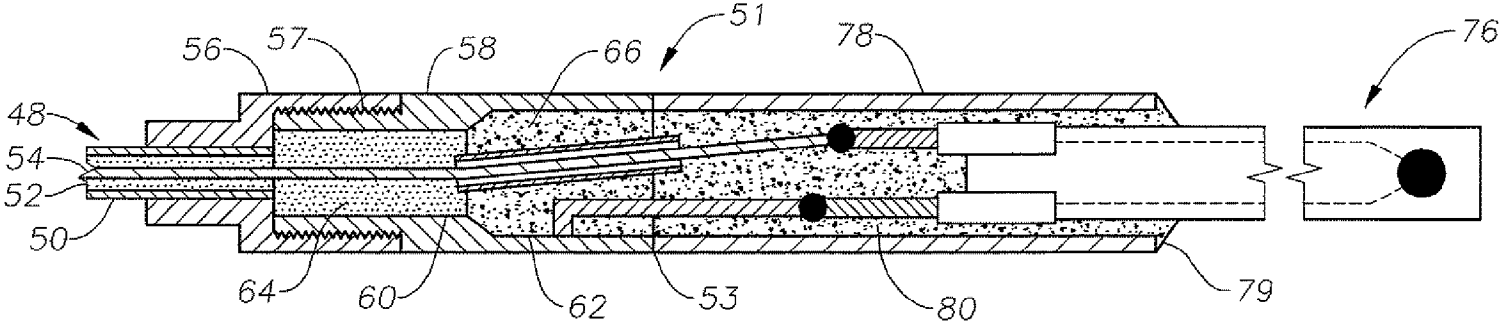

FIGS. 5 and 6 illustrate, in side cutaway views, embodiments of a compressive fitting for a MIMS cable, wherein the second conductive element is part of or connected to an electrical element. With reference now to FIG. 5, an embodiment of a splicing assembly 47 is provided. The splicing assembly 47 comprises a sleeve 58 affixed to a compression nut 56 for attachment to an element sleeve 78. The combination of the compression nut 56 and the sleeve 58 secure a cable assembly 48 therein; the element sleeve 78 houses a corresponding electrical component 76 therein. The compression nut 56 is a generally annular body having an aperture 55 extending coaxially therethrough and with a threaded opening on one end.

The sleeve 58 also is an annular body having chambers formed therein and having threads formed along the outer section of one end of the body. The threads on the sleeve 58 correspond to the threads on the inner opening of the compression nut 56. Thus, the sleeve is attached to the compression nut by virtue of these corresponding threads forming a threaded connection 57. The sleeve 58 includes a first chamber 60 proximate to the compression nut 56 and generally coaxial with the compression nut 56. The second chamber 62 extends from the terminal end of the first chamber 60 and terminates at the open end 61 of the sleeve 58. The second chamber diameter increases as it extends away from the first chamber 60. A ground wire 70 is shown attached to the inner annulus of the sleeve 58 and disposed within the second chamber 62. The ground wire 70 extends outside of the sleeve 58 past the open end 61.

The cable assembly 48 comprises a conductor 54 extending along the axis of the cable assembly 48 and insulation covered by a sheath 50, wherein the insulation 52 and the sheath 50 extend along a portion of the conductor 54. The cable assembly 48 is shown inserted into the annular opening of the compression nut 56 and into its aperture 55. The sheath 50 and insulation 52 terminate at the junction of the compression nut annulus and the first chamber 60. However, the conductor 54 extends past this juncture through the first chamber 60 and second chamber 62 and extends past the opening 61 of the sleeve 58. A guide tube 68 is shown disposed within the sleeve 58 extending from within the first chamber 60, through the second chamber 62 and terminating outside the opening 61 of the sleeve 58. The guide tube 68 is positioned at an oblique angle to the sleeve axis and formed to receive the conductor 54 therein.

One mode of forming the compression portion of the splicing assembly 47 comprises anchoring the guide tube 68 within the second chamber by injecting cement 66 into the second chamber. The cement may be potable air curable cement. Once the cement 66 within the sleeve 58 has cured and provides a structural foundation, insulation 64 may be inserted into the sleeve 58 from the upper portion. The insert may be a preform, such as illustrated in FIGS. 1-3 or may be in powdered form poured into the first chamber 60. Examples of suitable insulation include mineral insulation such as described above. After adding the insulation, the compression nut 56 may be drawn down along the cable assembly 48 into threaded cooperation with the threads on the sleeve 58. The corresponding threads of the compression nut 56 and the sleeve 58 produces a compacting force on the insulation 64 disposed within the first chamber 60. At this point, the compression nut 56 may be seal welded (or braised) to the cable assembly 48 which seals the back end of the fitting. To avoid the moisture issues previously described, the insulation may be added within the sleeve 58 in a controlled environment, i.e., conditioned air or under nitrogen blanket, or the assembled may be heated for a period of time to be sure any moisture trapped within the insulation is evaporated. After dry out (bake out) the guide tube 68 and the conductor 54 may be seal welded together thereby forming a hermetic connection.

After making up the compression portion of the splicing assembly 47, the electrical component 76 may be attached. The attachment step comprises electrically connecting leads (72, 74) of the component 76 with the conductor 54 and the ground wire 70. The connection may be formed by soldering, welding, brazing, or applying electrically conducting adhesives. After connecting the corresponding leads, the element sleeve 70 is brought into mating contact with the open end of the sleeve 58 and secured thereto. The element sleeve 78 may be soldered, glued, welded onto the sleeve 58 to form a connection, optionally corresponding threads may be provided on these two members for mating thereto. In the open space around the connections between the leads, potable cement may be injected into this space thereby filling the void and providing insulation and structural support around these members. One example of suitable cement may be obtained from Sauereisen, Inc., 160 Gamma Drive, Pittsburgh, Pa. 15238, Ph: 412-963-0303. Other cements include Aremco 586 available from Aremco Products, Inc., P.O. Box 517, 707-B Executive Blvd., Valley Cottage, N.Y. 10989, Phone: (845) 268-0039, Fax: (845) 268-0041; another cement vendor is CoPronicks. The cement 80 may then be cured and set and an optional seal 79 can be added in the open annular space between the terminal end of the element sleeve 78 and the body of the electrical component 76. The electrical component 76 may be one of a heating element, an igniter, or a pilot. Other components may be any sensing device such as a thermalcouple, temperature/pressure/level device, chemical sensor (oxygen sensor), gas detector, flame ionization detector, signal device, alarm, or a light source.

Figure 7:
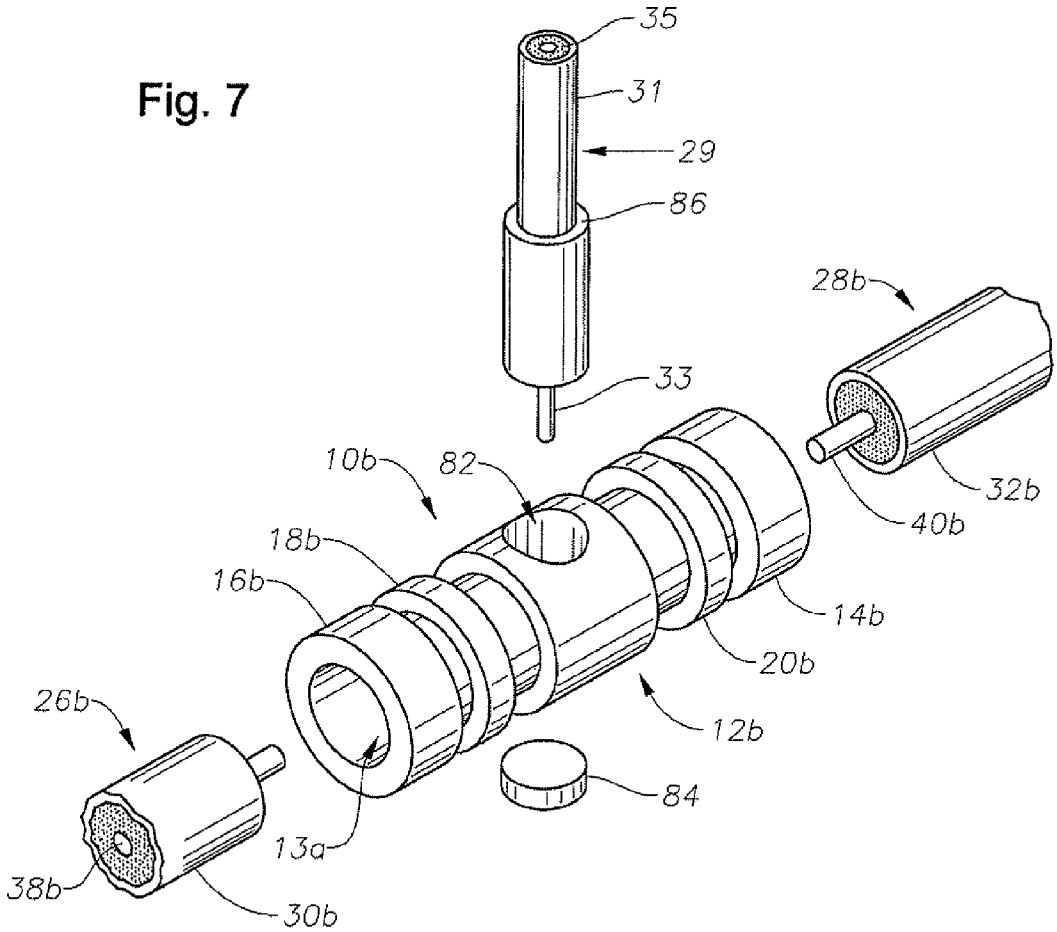
FIG. 7 is a perspective view of an embodiment of a MIMS cable coupling.
Figure 8:
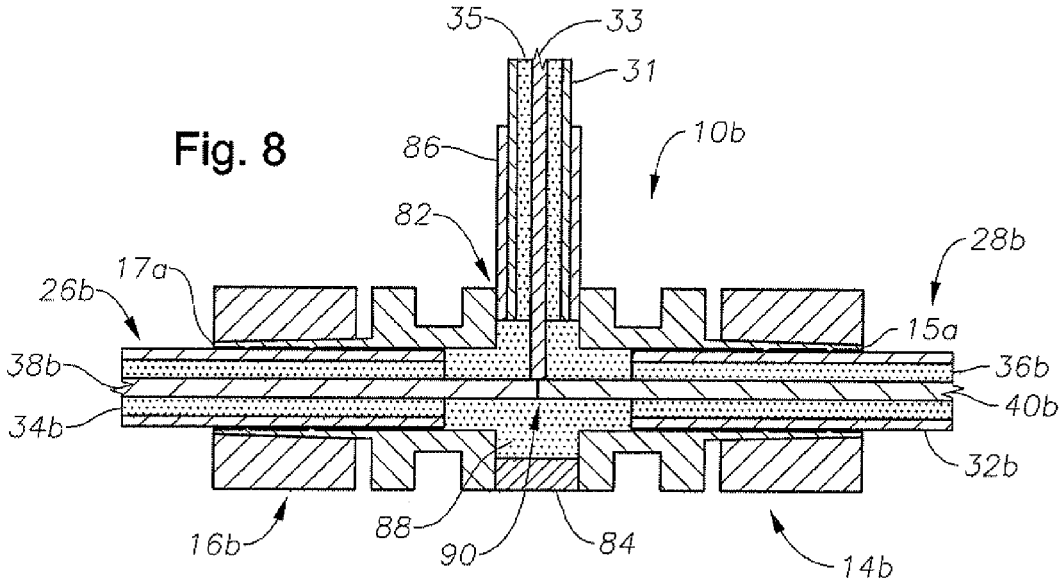
FIG. 8 is a cut-away side view of the MIMS cable coupling of FIG. 7.

Referring now to FIGS. 7 and 8, an embodiment of a MIMS cable connection is provided illustrating a splicing connection suitable for more than two electrically conducting elements. With reference now to FIG. 7, an exploded perspective view of an embodiment of a coupling is shown. The coupling includes a generally annularly shaped coupling body **12*b* having a first aperture 13*a* formed therethrough substantially parallel to the axis of the body 12*b*. A second aperture 82 provided bisects the first aperture 13*a* and extends perpendicular to the body axis providing openings on the top and bottom portions of the body 12*b***.

The body **12*b* comprises swage rings (14*b*, 16*b*) with corresponding flanges (18*b*, 20*b*) and sleeves (15*a*, 17*a*) that operate in similar fashion to the coupling illustrated in FIGS. 1-3. Accordingly, the body is configured to receive and secure therein cable assemblies (26*b*, 28*b*) through its aperture 13*a*. The cable assemblies shown have substantially similar components to the cable assemblies illustrated in FIGS. 1-3, i.e., a conducting element (38*b*, 40*b*), insulation (34*b*, 36*b*), and a metal sheath (30*b*, 32*b***).

A connector sleeve 86 is provided on the outer circumference of the third cable assembly 29 for anchoring this assembly to the connector. The third cable assembly 29 comprises a third conducting element 33, insulation 31 on the element 33 that is shrouded by a metal sheath 31. As illustrated in cross-sectional view in FIG. 8, the third cable assembly 29 is inserted through the aperture 82 thereby forming a connection 90 for providing electrical communication between the three electrically conducting elements (**38*b*, 40*b*, 33). The connecting sleeve 86 may be securable to the aperture 82 within the body 12***b*. Securing means for connecting the connector sleeve 86 to the body 12*b* include welding as well as a threaded connection. Optionally, the cable assembly 29 may be press fit into the aperture 82 to secure the cable assembly 29 to the body 12*b*. On its inner circumference, the connector sleeve 86 is adhered to the outer surface of the metal sheath 31. Thus, by securing the connector sleeve to the coupling 10*b*, the third cable assembly 29 connects to the coupling 10*b* as well. A seal weld may be included to seal the connection between the cable assembly 29 and the coupling 10*b*. The cable assemblies (26*b*, 28*b*, and 29) are not limited to the same size, but instead may be the same size or of varying sizes.

A plug 84 is provided for ingress to the annulus of the body 12*b*. The access provided by the plug 84 enables making up the connection 90 and also provides for the option of adding additional insulation 88 into the annulus after the connection 90 is formed. In one example, insulation (MgO) is poured into the annulus in thereby filling all voids inside, the body 12*b* is then vibrated to pack the powder and fill all voids. Then plug 84 is added thereby compressing the powdered insulation, then the plug 84 is seal welded into place. Optionally, the annulus may be filled with curable cement. In one other optional embodiment, the connector sleeve 86 is replaced by a compression fitting such as the compression fittings utilizing the swage rings described herein Moisture may be removed from the insulation before the swage rings (14*b*, 16*b*) are activated, for example by heating the insulation after inserting the plug 84.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. The assembly described herein is useable with cable assemblies having more than one conductive element. One of the advantages of the device and method disclosed herein is that described connectors are operable at substantially the same maximum operating conditions experienced by the associated cable assemblies. Accordingly, the invention is therefore to be limited only by the scope of the appended claims.

The invention claimed is:

1. A splice assembly for a mineral insulated metal sheathed cable comprising:

a cable assembly comprising a first conducting element and mineral insulation disposed on the first conducting element;

a connection between the first conducting element with a second conducting element;

an annular sleeve around the cable assembly, the sleeve having an outer radius that increases along its length to define an inclined surface; and a compression fitting slideable from a non-compressive position along the annular sleeve in a direction of increased radius to a compressive position, so that when the compression fitting is in the compressive position the inclined surface is inwardly deformed to provide an inward compressive force onto the cable assembly.

2. The splice assembly of claim 1, wherein the compression fitting comprises a swage ring coaxially slideable over the sleeve.

3. The splice assembly of claim 2, wherein positioning the swage ring on the incline compresses the sleeve thereby inwardly deforming the sleeve annular diameter.

4. The splice assembly of claim 1, wherein the coupling comprises a compressive fitting.

5. The splice assembly of claim 1, further comprising mineral insulation disposed on the second conducting element.

6. The splice assembly of claim 1, further comprising an electrical element in electrical communication with the second conducting element.

7. The splice assembly of claim 6, wherein the electrical element is selected from the group consisting of a heating element, an igniter, a pilot light, a sensing device, a thermalcouple, a temperature sensor, a pressure sensor, a level sensor, a chemical sensor (oxygen sensor), a gas detector, a flame ionization detector, a signal device, an alarm, and a light source.

8. The splice assembly of claim 1, further comprising a third conducting element joined at the connection.

9. The splice assembly of claim 8, further comprising mineral insulation disposed on the third conducting element.

10. The splice assembly of claim 8, further comprising a coupling mechanically affixed to the compression fitting and in securing engagement with the third conducting element.

11. The splice assembly of claim 1, further comprising mineral insulation disposed on the connection.

12. The splice assembly of claim 11, wherein the mineral insulation comprises a split preform.

13. A method of forming a spliced connection between first and second electrically conducting elements respectively from first and second cable assemblies each having a mineral insulated metal sheath over the elements, the method comprising:

providing an annular sleeve with a portion having an outer radius that increases along the sleeve length and an annular swage ring slideable over the annular sleeve;

sliding the annular sleeve onto one of the cable assemblies;

forming a connection between the first and second electrically conducting elements;

positioning the sleeve over the connection; and sliding the swage ring from a non-compressive position along the sleeve in a direction of increasing sleeve radius to inwardly deform the sleeve and compressively affix the sleeve to the mineral insulated metal sheathed cable assembly.

14. The method of claim 13, wherein the sleeve comprises a second portion having a radius that increases with length, the method further comprising, positioning the second portion over the second cable assembly, providing a second swage ring over the sleeve, and sliding the second swage ring over the second sleeve in a direction of increasing sleeve radius to compressively engage the sleeve with the second assembly.

15. The method of claim 13, further comprising providing mineral insulation over the connection.

16. The method of claim 13 wherein the second electrically conducting element is in electrical communication with an electrical component.

17. The method of claim 16, wherein the electrical component is selected from the group consisting of a heating element, an igniter, and a pilot.

18. The method of claim 13 further comprising joining a third electrically conducting element with the connection.

19. The method of claim 13 further comprising removing insulation from the electrically conducting elements.

20. The method of claim 13 further comprising adding cement to the area around the connection.

21. An apparatus for splicing a mineral insulated metal sheathed cable assembly comprising:

an annular coupling body comprising a sleeve having an outer surface and an inclined portion on the outer surface;

a connection formed by joining a first electrically conducting wire and a second electrically conducting wire, wherein the connection is disposed within the body;

mineral insulation disposed on the first electrically conducting wire and a sheath on the insulation thereby forming a cable assembly, wherein at least a portion of the cable assembly extends into the body; and a swage member slidingly positioned on the inclined portion of the sleeve outer surface inwardly deforming the sleeve into compressive engagement with the cable assembly and affixing the cable assembly within.

22. The apparatus of claim 21 further comprising mineral insulation shrouded by a sheath disposed on the second electrically conducting wire, thereby forming a second cable assembly, wherein at least a portion of the second cable assembly extends into the body.

23. The apparatus of claim 21 further comprising a third electrically conducting wire adjoined to the connection.

24. The apparatus of claim 22 further comprising a second sleeve over the second cable assembly, wherein the second sleeve includes an inclined portion with a swage member slidingly positioned on the included portion inwardly deforming the second sleeve into compressive engagement with the second cable assembly and affixing the cable assembly to the body.

25. The apparatus of claim 21, further comprising an electrical element connected to the second electrically conducting wire, wherein the electrical element is selected from the list consisting of a heating element, an igniter, and a pilot.

* * * * *